US007664564B2

(12) United States Patent
Kawasaki et al.

(10) Patent No.: US 7,664,564 B2
(45) Date of Patent: Feb. 16, 2010

(54) DEVICE, METHOD AND PROGRAM FOR DESIGNING KNIT PRODUCT

(75) Inventors: Junko Kawasaki, Wakayama (JP); Kouichi Urano, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 227 days.

(21) Appl. No.: 11/816,563

(22) PCT Filed: Feb. 6, 2006

(86) PCT No.: PCT/JP2006/301954

§ 371 (c)(1),
(2), (4) Date: Aug. 17, 2007

(87) PCT Pub. No.: WO2006/087929

PCT Pub. Date: Aug. 24, 2006

(65) Prior Publication Data

US 2009/0019895 A1 Jan. 22, 2009

(30) Foreign Application Priority Data

Feb. 18, 2005 (JP) ..... 2005-042498

(51) Int. Cl.
*D04B 7/24* (2006.01)

(52) U.S. Cl. ..... 700/141

(58) Field of Classification Search ..... 66/231, 66/232; 700/141, 131, 132, 135
See application file for complete search history.

(56) References Cited

U.S. PATENT DOCUMENTS 4,078,253 A * 3/1978 Kajiura et al. ..... 700/131
5,812,110 A * 9/1998 Kawasaki et al. ..... 700/141
6,611,730 B1 * 8/2003 Stoll et al. ..... 700/131
6,845,284 B2 * 1/2005 Bingham et al. ..... 700/141
6,880,367 B2 * 4/2005 Suzuki ..... 66/232
7,127,321 B2 * 10/2006 Kenji et al. ..... 700/141
7,181,309 B2 * 2/2007 Kazuyoshi ..... 700/141
7,197,371 B2 * 3/2007 Koichi et al. ..... 700/141
7,203,566 B2 * 4/2007 Terai et al. ..... 700/141
7,330,772 B2 * 2/2008 Suzuki ..... 700/139
7,379,786 B2 * 5/2008 Koichi ..... 700/135
7,460,927 B1 * 12/2008 Lai ..... 700/141
2006/0179894 A1 * 8/2006 Koichi et al. ..... 66/64
2006/0206231 A1 * 9/2006 Koichi et al. ..... 700/141

FOREIGN PATENT DOCUMENTS

WO WO 2004/088022 A1 10/2004
WO WO 2004/092468 A1 10/2004

* cited by examiner

*Primary Examiner*—Danny Worrell
(74) *Attorney, Agent, or Firm*—Rothwell, Figg, Ernst & Manbeck, P.C.

(57) ABSTRACT

A setting area is stored in association with the external shape of a knitted fabric, and the setting area is altered as the external shape is altered. A unit pattern is vertically copied repeatedly in the setting area. When setting patterns exist on both sides of the boundary between front and rear knitted fabrics, the boundary being a start point of circumferential formation, the setting pattern on the start section side is shifted upward by one course. The range for providing the setting pattern therein can be altered automatically when the external shape of the knitted fabric is altered. Furthermore, the setting pattern does not become discontinuous in a course direction at the boundary between the front and rear knitted fabrics.

9 Claims, 9 Drawing Sheets

DEVICE, METHOD AND PROGRAM FOR DESIGNING KNIT PRODUCT

CROSS REFERENCE TO RELATED APPLICATION

This application is a 35 USC § 371 National Phase Entry Application from PCT/JP2006/301954, filed Feb. 6, 2006, and designating the United States.

TECHNICAL FIELD

The present invention relates to designing a tubular knit product by using a flat-knitting machine.

BACKGROUND ART

In most knit products such as a sweater, a vest and a one-piece garment, a setting is formed on each end section of a knitted fabric. The setting is configured from structural patterns constituting a width of approximately several wales from the end section of the knitted fabric, and has a structural design that is different from the design of the other sections of the knitted fabric. When, for example, forming a front fabric and a rear fabric simultaneously or when forming both sleeves of the front fabric and rear fabric simultaneously by circumferentially forming in a tubular form, settings are formed on the armholes, waist, collar, inside and outside of the sleeves and the like of the front and rear fabrics. In this case, the inside or the outside of the waist and each sleeve is a section for connecting the front and rear knitted fabrics.

The applicant has proposed in WO 04/088022A1 how to simply design a setting pattern. An area for forming a setting has a width of approximately several wales from an edge of a knitted fabric. Therefore, by aligning this section so that the wale direction becomes virtually vertical, a vertically long rectangle is created, for example. This section is taken as a setting area, and by copying a unit pattern having one through several courses aligned vertically to this setting area so as to fill this setting area, the setting can be designed easily.

It is preferred that the shape of the setting area be altered when the external design of the knit product is altered. However, the inventor has focused attention on that the method described in WO 04/088022A1 cannot handle such alteration. When circumferentially forming a knit product, the point for starting the circumferential formation is located in, for example, the boundary between the front fabric and the rear fabric. A setting is usually formed on each side of this boundary. The inventor has focused attention on that the setting pattern on each side of the circumferential formation start point of the knit product obtained after the formation is different from the design data of the knit. Specifically, the setting pattern disposed on the same course according to the design data is shifted upward or downward by one course at each side of the circumferential formation start point in the actual knit product. If the design of the setting pattern changes along a wale direction, i.e., if the type of a stitch changes at every course, the types of stitches become uneven at both sides of the circumferential formation start point, which is not preferred in terms of the design.

DISCLOSURE OF THE INVENTION

An object of the present invention is to easily design a setting pattern by:

1) Altering a setting area in response to an alteration of the external shape of a knit product; and 2) Preventing the setting pattern from being shifted vertically at each side of the circumferential formation start point, when circumferentially forming the knit product.

A secondary object of the present invention is:

3) To prevent the occurrence of an area that has no data on a type of a stitch, when preventing the setting pattern from being shifted vertically.

The designing device of the present invention is a device for creating design data of a knit product in order to form a cylindrically-shaped fabric constituted by front and rear knitted fabrics by means of a flat-knitting machine by circumferentially moving a yarn carrier, and to form a setting pattern on an end section of each of the knitted fabrics, the device being provided with: designating means for accepting that a setting area is designated and storing the designated setting area in association with an external shape of each of the knitted fabrics; modifying means for modifying the setting area in response to an alteration of an external design of each of the knitted fabrics; expanding means for storing data on the setting pattern and expanding the pattern through the entire setting area; detecting means for detecting that the setting area exists in both circumferential direction start section and end section located respectively on both sides of a carrier circumferential movement start section and that the setting area also exists so as to continue along a course direction between the start section and the end section; and correcting means for moving on the data, at the time of the detection, the setting pattern located on the start section side relatively upward to the end section side by one course.

Preferably, the designating means accepts that the both end sections of the setting area are designated, stores the designated both end sections in association with the external shape of each of the knitted fabrics, and stores an area of a predetermined number of wales between the designated ends as the setting area, the predetermined number of wales being counted inward from an edge of each of the knitted fabrics. Also, preferably the modifying means moves both of the end sections in response to the alteration of the external design of each of the knitted fabrics, and the expanding means stores data on a pattern in units of the setting pattern, and copies the data so that the pattern spreads through the entire setting area.

It is particularly preferred that, on the start section side, the correcting means move, on the data, the uppermost course of the setting pattern to the lowermost course of the setting pattern, and shift on the data a setting pattern of another course upward by one course.

The designing method of the present invention is a method of creating design data of a knit product in order to form a cylindrically-shaped fabric constituted by front and rear knitted fabrics by means of a flat-knitting machine by circumferentially moving a yarn carrier, and to form a setting pattern on an end section of each of the knitted fabrics, the method comprising: accepting that a setting area is designated and storing the designated setting area in association with an external shape of each of the knitted fabrics; modifying the setting area in response to an alteration of an external design of each of the knitted fabrics; storing data on the setting pattern and expanding the pattern through the entire setting area; and when detection is made that the setting area exists in both circumferential direction start section and end section located respectively on both sides of a carrier circumferential movement start section and that the setting area also exists so as to continue along a course direction between the start section and the end section, moving on the data the setting pattern located on the start section side relatively upward to the end section side by one course.

Preferably, in the designating, designation of the both end sections of the setting area is accepted, the designated both end sections are stored in association with the external shape of each of the knitted fabrics, and an area of a predetermined number of wales between the designated ends is stored as the setting area, the predetermined number of wales being counted inward from an edge of each of the knitted fabrics. In the modifying, the both end sections are moved in response to the alteration of the external design of each of the knitted fabrics. In the expanding, data on a pattern in units of the setting pattern is stored and then copied so that the pattern spreads through the entire setting area.

It is particularly preferred that, in the upward movement by one course, on the start section side, the uppermost course of the setting pattern is moved on the data to the lowermost course of the setting pattern, and a setting pattern of another course is shifted on the data upward by one course.

The designing program of the present invention is a program for creating design data of a knit product in order to form a cylindrically-shaped fabric constituted by front and rear knitted fabrics by means of a flat-knitting machine by circumferentially moving a yarn carrier, and to form a setting pattern on an end section of each of the knitted fabrics, the program being provided with: a designating command for accepting that a setting area is designated and storing the designated setting area in association with an external shape of each of the knitted fabrics; a modifying command for modifying the setting area in response to an alteration of an external design of each of the knitted fabrics; an expanding command for storing data on the setting pattern and expanding the pattern through the entire setting area; a detecting command for detecting that the setting area exists in both circumferential direction start section and end section located respectively on both sides of a carrier circumferential movement start section and that the setting area also exists so as to continue along a course direction between the start section and the end section; and a correcting command for moving on the data, at the time of the detection, the setting pattern located on the start section side relatively upward to the end section side by one course.

Preferably, the designating command is used to accept that the both end sections of the setting area are designated, store the designated both end sections in association with the external shape of each of the knitted fabrics, and store an area of a predetermined number of wales between the designated ends as the setting area, the predetermined number of wales being counted inward from an edge of each of the knitted fabrics. Also, preferably the modifying command is used to move the both end sections in response to the alteration of the external design of each of the knitted fabrics, and the expanding command is used to store data on a pattern in units of the setting pattern, and to copy the data so that the pattern spreads through the entire setting area.

It is particularly preferred that, on the start section side, the correcting command be used to move, on the data, the uppermost course of the setting pattern to the lowermost course of the setting pattern, and to shift setting pattern, on the data, of another course upward by one course.

Since the present invention relates to designing a knit program, the concepts of the external shape of a knitted fabric, the setting area, the setting patterns and the like are the same as the concept on the design data of the knit product. Furthermore, "course" means a row of stitches arranged in the horizontal direction of the knitted fabric, and "wale" means a row of stitches arranged in the vertical direction of the knitted fabric. Relative movement by one course includes moving one of the setting pattern data items upward and moving another one downward. In the present specification, the descriptions related to the designing device for designing a knit product are directly applied to the designing method and designing program, while the descriptions related to the designing method are directly applied to the designing device and designing program. Designation of both end sections of a setting area means to designate, for example, characteristic points of the both end sections.

According to the present invention, since the setting area is stored in association with the data on the external shape of each knitted fabric, the setting area is altered if the external shape of the knitted fabric is altered. Therefore, it is not necessary to redesign the setting patterns in response to the alteration of the external shape of the knitted fabric.

Also, according to the present invention, if the setting area exists on each side of the carrier circumferential movement start section, the setting pattern on the start section side is relatively slid upward by one course toward the end section side. Accordingly, the setting patterns of the front and rear knitted fabrics can be prevented from becoming discontinuous in the course direction.

Here, on the data the uppermost course of the setting pattern on the start section side is moved to the lowermost course of the setting pattern, and setting pattern, on the data, of another course is shifted upward by one course so that the setting area itself does not move vertically. Therefore, the data on the type of a stitch can be prevented from being lost in the lowermost course of the setting area.

EXPLANATION OF REFERENCE NUMERALS

Figure 1:
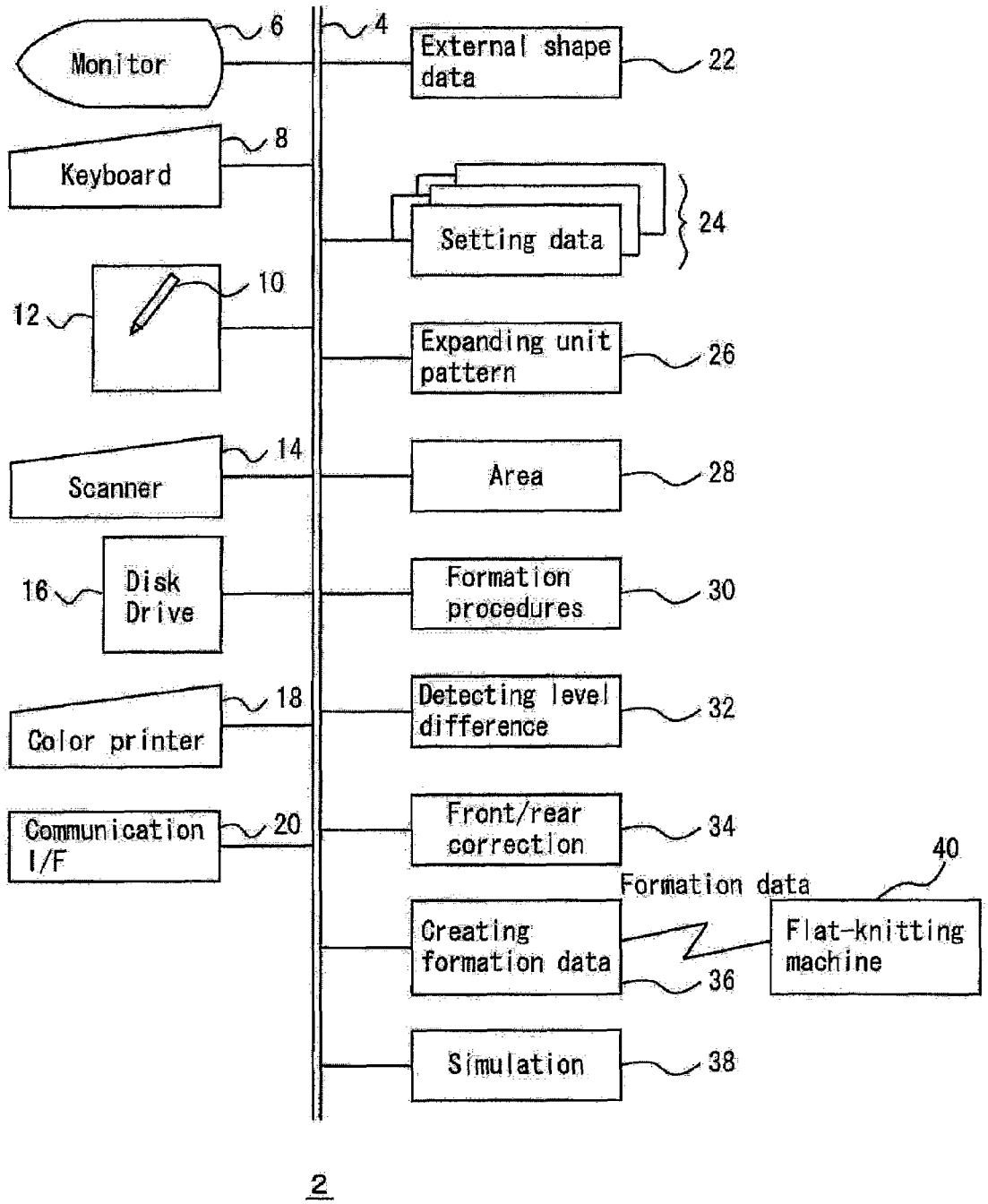
FIG. 1 is a block diagram of a knit designing device of embodiments.

2 knit designing device 4 bus 6 color monitor 8 keyboard 10 stylus 12 digitizer 14 color scanner 16 disk drive 18 color printer 20 communication interface 22 external shape data storage section 24 setting data storage section 26 unit pattern expanding section 28 area modifying section 30 formation procedure processing section 32 level difference detecting section 34 front/rear correction section 36 formation data creating section 38 simulation section 40 flat-knitting machine 42 setting program 43 setting data storage command 44 unit pattern expanding command 45 area modifying command 46 formation procedure processing command 47 level difference detecting command 48 front/rear correction command 50 sweater 51 through 64 setting area 66, 66' setting layer 68, 68' edge 70 circumferential formation 72, 73 stitch array in natural state 74 rear knitted fabric data 75 front knitted fabric data 76 stitch array on formation data 90, 91 setting pattern 92 data of uppermost level 93 data of levels other than uppermost level P1, P2, P2' characteristic point A start point B end point C half-cycle point D start point E inverted section

BEST MODE FOR CARRYING OUT THE INVENTION

The best embodiments for carrying out the present invention are described hereinafter.

FIG. 1 through FIG. 11 show the embodiments. In these figures, reference numeral 2 represents a knit designing device, and reference numeral 4 represents a bus. Regarding an input/output system, reference numeral 6 represents a color monitor, reference numeral 8 represents a keyboard, reference numeral 10 represents a stylus, and reference numeral 12 represents a digitizer. A position on design data is designated by the stylus 10 and digitizer 12 to input a graphic image. Reference numeral 14 represents a color scanner, reference numeral 16 represents a disk drive, reference numeral 18 represents a color printer, and reference numeral 20 represents a communication interface.

A knitted fabric to be designed has a tubular shape and comprises, for example, a front fabric, a rear fabric, and/or sleeves attached to these fabrics. The types of a knit product include a sweater, a vest, a one-piece garment, a pair of pants, a pair of slacks, and the like. An external shape data storage section 22 stores data on the external shape of the knit product in units of the front and rear knitted fabrics, wherein the knitted fabrics used as the unit are, for example, a front fabric, a rear fabric, a right front sleeve, a right rear sleeve, a left front sleeve and a rear left sleeve.

A setting data storage section 24 stores data on setting patterns and a setting area for each setting area. Setting areas are, for example, armholes of the front and rear fabrics, waist, collar, rear shoulder, and the like. Settings are formed on the lower sleeve sections or sleeve caps on both sleeves of the front and rear knitted fabrics. Design layers are provided in the setting areas respectively, and setting data is stored as data on each layer. Also, each setting area is an area within the layer. A unit pattern expanding section 26 vertically copies and expands a unit pattern, which is a unit of the setting pattern, into the setting area. The unit pattern consists of approximately one through several courses in height, and approximately several wales in width, which is counted inward from an edge of the knitted fabric. A pattern in which the unit pattern is repeated periodically is the setting pattern. Furthermore, the unit pattern cannot be broken into smaller patterns. The unit pattern is stored in the setting data storage section 24, unit pattern expanding section 26 or the like.

An area modifying section 28 alters the setting area in response to an alteration of the external shape data stored in the external shape data storage section 22. The setting data storage section 24 stores the setting area by means of a characteristic point on the external shape of each of the knitted fabrics. When the external shape data is altered the characteristic point is moved, thus the setting area can be changed accordingly. The setting area may be stored by means of the characteristic point on the external shape that is altered as the external shape data of the knitted fabric is altered, and it is not always necessary to store the characteristic point. A formation procedure processing section 30 makes a determination on the formation procedures, such as which carrier should be allocated to which part of the knitted fabric for formation, which direction to circumferentially move the carrier, and therefore how the carrier of the flat-knitting machine should be moved. Standard conditions, for example, may be stored to allocate the formation procedures automatically, and only when a particular procedure is used a user may designate such particular procedure. In the embodiments, a tubular knitted fabric is formed, thus the carrier circumferentially moves along the knitted fabric. Such formation is called "circumferential formation."

A level difference detecting section 32 detects a level difference generated between the setting patterns at the boundary between the front and rear knitted fabrics. Generally, circumferential formation is started from the boundary between the front and rear knitted fabrics, and the level difference is generated between a wale start side and a wale end side of the circumferential formation start point. Therefore, the level difference is generated at, for example, the boundary between the front and rear knitted fabrics. The place where the level difference is generated is located between the start side and the end side of the circumferential formation start point. A front/rear correcting section 34 shifts the setting pattern located on the circumferential formation start side, upward by one course with respect to the section where the level difference is generated, corrects the level difference generated between the setting patterns on the respective front and rear knitted fabrics, and changes the front and rear setting patterns to patterns that are continuous in the course direction. A formation data creating section 36 creates formation data for the designed knit product, and a simulation section 38 performs visual simulation on the knit product on the basis of the created formation data. The formation data is input to a flat-knitting machine 40 via communication or a disk, whereby the flat-knitting machine 40 forms a sweater or the like.

Figure 2:
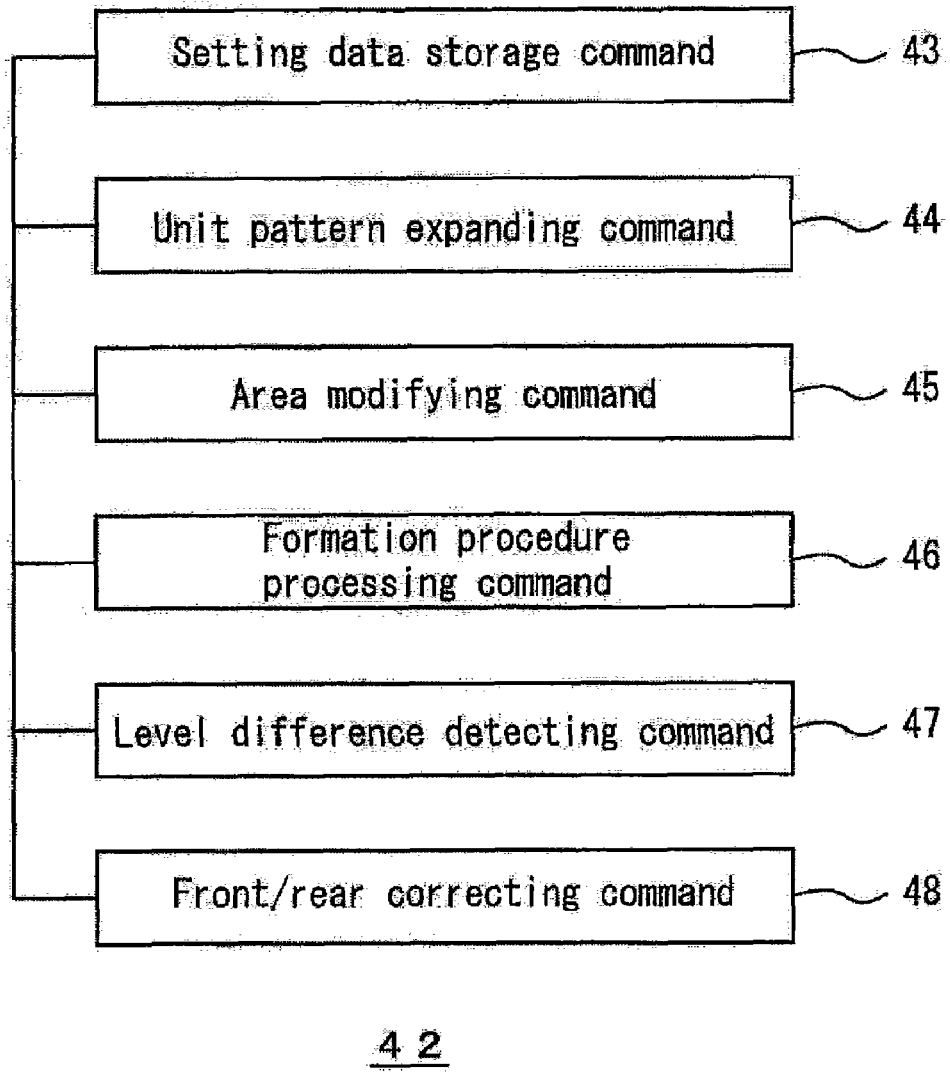
FIG. 2 is a substantial block diagram of the knit designing program of the embodiments.

FIG. 2 shows a setting program 42 of the embodiments. The setting program 42 is a part of the knit designing program. A setting data storage command 43 is a command to store the data on the unit pattern and setting patterns, and the setting area, a unit pattern expanding command 44 is a command to expand the unit pattern in the setting area, and an area modifying command 45 is a command to detect a change in the external shape of the knitted fabric and modifies the setting area. A formation procedure processing command 46 is a command to perform processing on the formation procedures, and to particularly detect the circumferential direction of the carrier. A level difference detecting command 47 is a command to detect whether or not a level difference is generated between the front and rear setting patterns. A front/rear correcting command 48 is a command to eliminate a level difference if there is any, by moving either the front or rear setting pattern vertically by one course.

Figure 3:
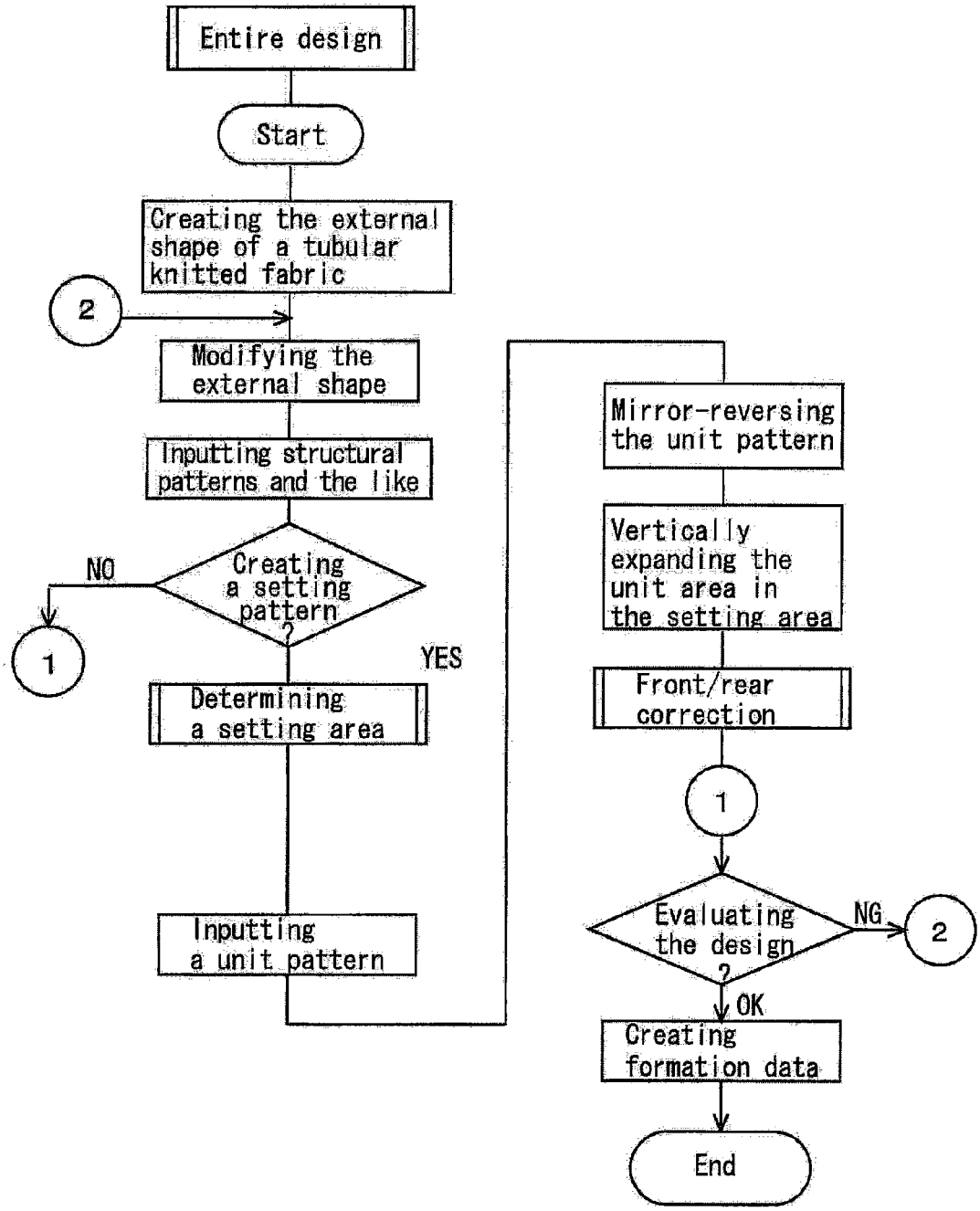
FIG. 3 is a flowchart showing an overview of a knit design according to the embodiments.

FIG. 3 shows the entire design of the knit product, including mainly the design of the setting pattern. First, the external shape data of a tubular knitted fabric is created, the shape of an existing knit product is read by, for example, the scanner 14, or the external shape data is read by the disk drive 16. Then, the stylus 10 or the like modifies the external shape data. Moreover, structural patterns such as ribs or patterns such as intersia or jacquard patterns are input to determine whether to create setting patterns.

When creating setting patterns, setting areas are determined, and a unit pattern of each setting area is input. In the case in which the setting areas are input so as to be symmetric on the right and left of the knitted fabric in such a manner that, for example, the armholes are input to the right and left knitted fabrics, the waist part is input to the right and left knitted fabrics etc., if a unit pattern is input to one of the setting areas, the unit pattern is input to another setting area in a mirror-reversed manner. Also, in the case in which the setting areas are provided in a continuous manner in an end section of each of the front and rear knitted fabrics, i.e., each of the front and rear waists, front and rear lower sleeve sections, or each of the front and rear sleeve caps, the unit pattern that is input to one of the setting areas is copied to the other setting area. This copying is performed so as to fold back the unit pattern with respect to the boundary between the front and rear knitted fabrics. Specifically, the unit pattern is copied so that the same type of stitch appears in the position on each of the front and rear knitted fabrics, the position being located the same number of wales away from the boundary between the front and rear knitted fabrics.

The unit pattern is copied such that the unit pattern is expanded vertically within each setting area. For example, the unit pattern is periodically and repeatedly copied upward, starting from the lowermost course of the setting area, to thereby fill the entire setting area with the unit pattern. It should be noted that the setting area is in principle designed on the front and rear knitted fabrics such that it starts with the same course number and ends with the same course number.

Whether or not the level difference is generated between the setting patterns on the respective front and rear knitted fabrics is detected, and, if the level difference is generated, the level difference between the front and rear setting patterns is corrected. Next, the design is displayed on the monitor so that the user can evaluate the design, and when modifying the design the user returns to the second connector. However, when the design is not modified, the formation data is created and the designing is ended.

Figure 4:
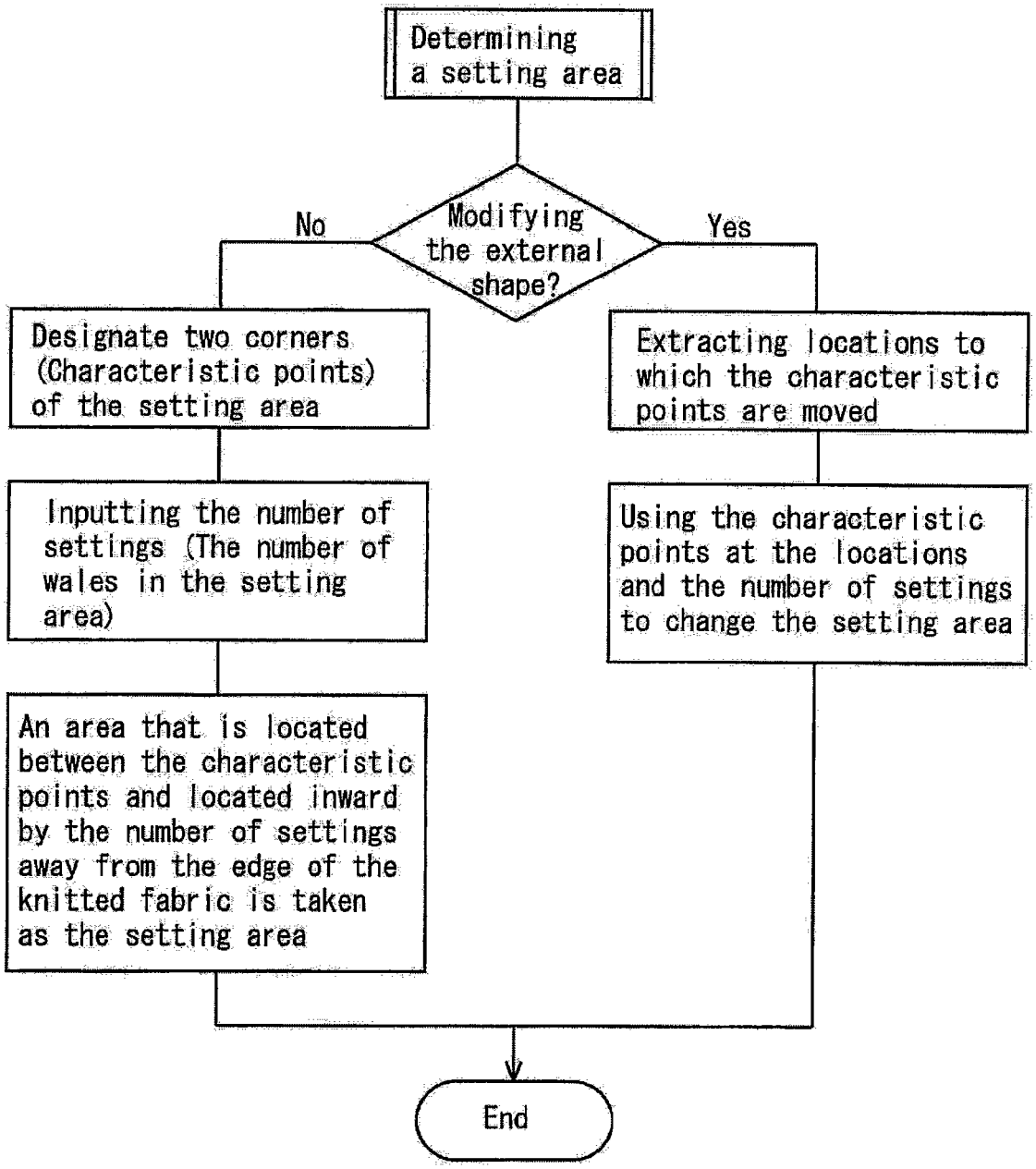
FIG. 4 is a flowchart showing an algorithm for determining a setting area according to the embodiments.

FIG. 4 shows an algorithm for determining the setting area. In the case in which modification of the external shape data of the knit product does not have to be considered in the initial stage of the designing, the user uses the stylus or the like to designate two corners (characteristic points) at respective both end sections of the setting area. The user then inputs the number of wales for expanding the setting pattern inward from the edge of each knitted fabric. The number of wales is called "the number of settings." Then, the area that is located between the two characteristic points and located inward by the number of settings away from the edge of the knitted fabric is taken as the setting area. In the case in which the external shape of the knitted fabric is modified, the places to which the characteristic points are moved are extracted, and the moved characteristic points and the input number of settings are used to modify the setting area.

Figure 5:
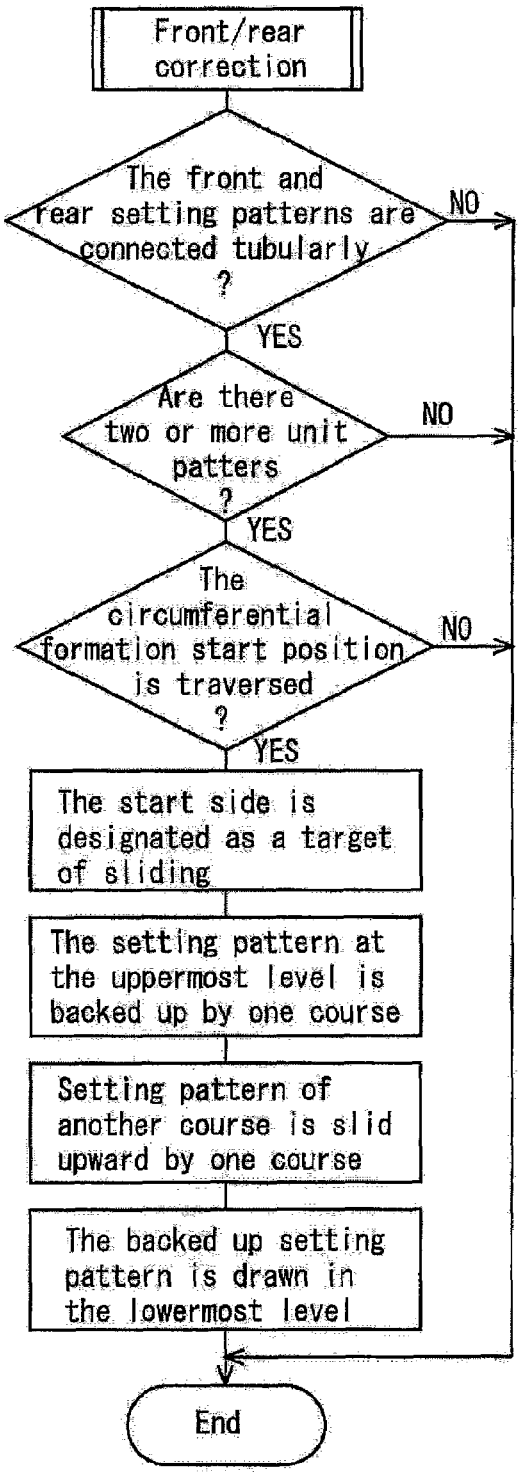
FIG. 5 is a flowchart showing an algorithm for correcting setting patterns on the front and rear knitted fabrics according to the embodiments.

FIG. 5 shows an algorithm for performing front/rear correction. If the front and rear setting patterns are connected in the form of a cylinder, and the unit pattern of each of the setting patterns is configured by two or more courses, this part is the target of front/rear correction. When the circumferential formation start position is present between the setting patterns on the respective front and rear knitted fabrics, front/rear correction is performed. In this case, the circumferential formation start side is the target of sliding, wherein the setting pattern at the uppermost level is backed up by one course, and the setting pattern of another course is slid upward from the bottom by one course. Then, the backed upsetting pattern is drawn to the lowermost course.

Figure 6:
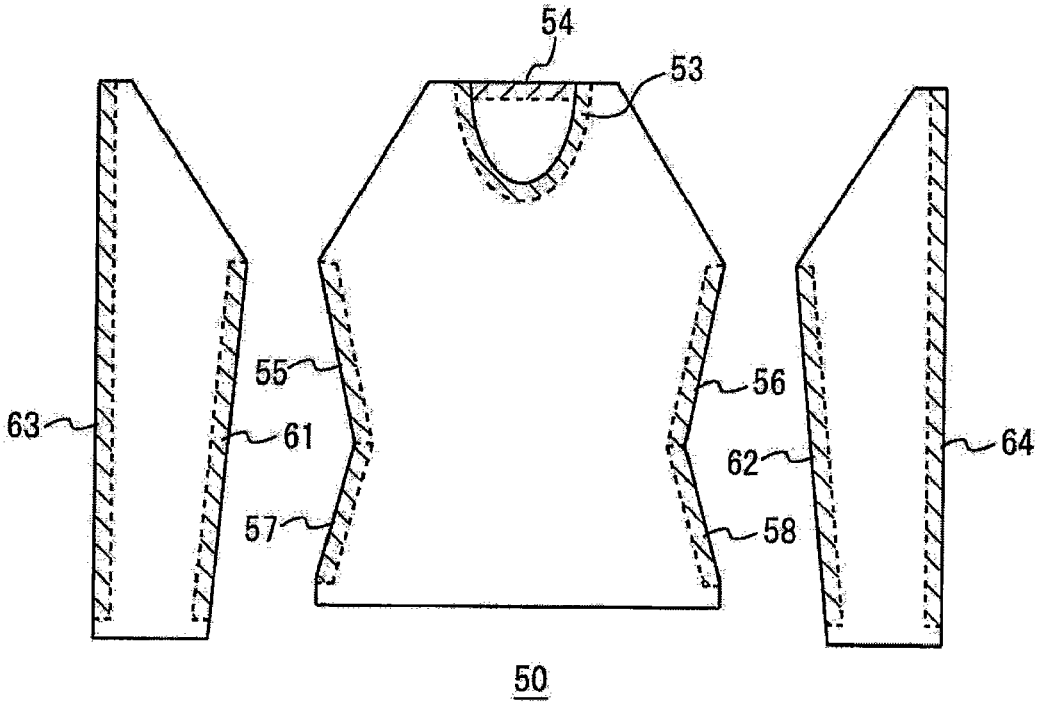
FIG. 6 is a view schematically showing an example of the setting area.

FIG. 6 shows an example of a sweater 50. Reference numerals 53 through 64 represent the setting areas respectively, reference numerals 55 and 56 represent the waist side setting areas respectively, and reference numerals 57 and 58 also represent the same setting areas respectively. Reference numerals 61 and 62 represent lower sleeve side setting areas respectively, and reference numerals 63 and 64 represent sleeve cap side setting areas respectively. These setting areas are constituted so as to be symmetric on the right and left of each of the front and rear knitted fabrics, except for the setting areas 53 and 54 corresponding to the collar. Furthermore, the shape of each setting area is input by the user using the stylus or the like. In addition to these setting areas, setting areas may be provided around the armholes and the like, but the front and rear setting areas are separated at the sleeves, thus no level difference is generated. For this reason, the explanation of the setting areas around the armholes is omitted.

Figure 7:
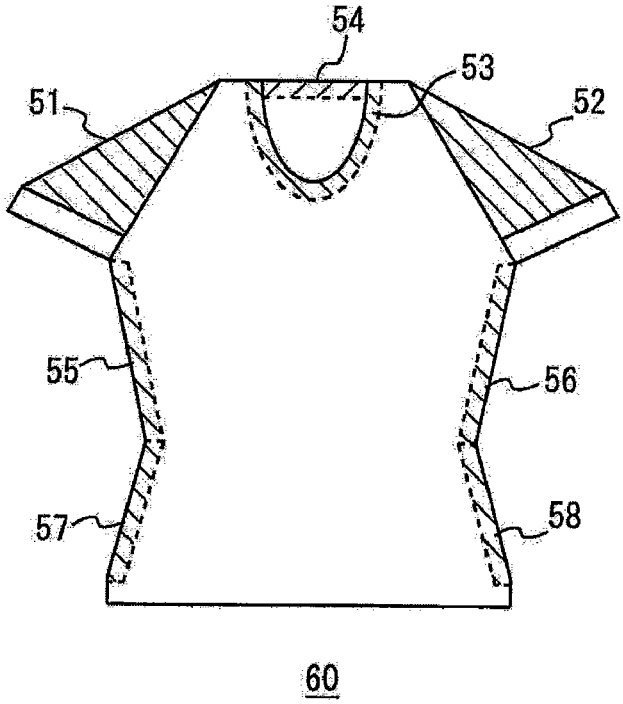
FIG. 7 is a view schematically showing a modification of the setting area.

FIG. 7 shows a short-sleeved sweater 60 in which the entire sleeves are provided with large setting patterns 51 and 52, and this figure illustrates a front fabric having the sleeves attached thereto. The setting areas 51 and 52 are symmetric on the right and left, and a rear fabric is also provided with the unshown setting areas such that the setting areas continue to the setting areas 51 and 52 and in the course direction and such that the number of setting courses are the same as the number of courses. When increasing the dimension of the unit pattern of each of the setting areas 51 and 52 so as to be larger than the size of each of the areas 51 and 52, the section within the unit pattern in each of the setting areas 51 and 52 is treated as a valid section, and the rest of the section is treated as an invalid section. When using a small unit pattern, the unit area is copied in the course direction and the wale direction and expanded to the entire setting areas 51 and 52. When designating the setting areas 51 and 52, for example three points of each of the triangular setting areas 51 and 52 are designated.

When forming the sweater 60, the section above the underarms is circumferentially formed as one whole cylinder, a level difference is generated between the front and rear setting areas at the side where there is a circumferential formation start point. Here, for example, the setting area located on the side where circumferential formation is started from the circumferential formation start point is slid upward by one course. To the lowermost course that no longer has a pattern, the formation data of, for example, the course therebelow is copied. Instead of sliding one of the setting patterns upward by one course, another setting pattern may be slid downward by one course. It should be noted that the level difference is generated only in either the left or right setting areas 51 or 52, i.e., on the side having the start point for starting circumferential formation.

Figure 8:
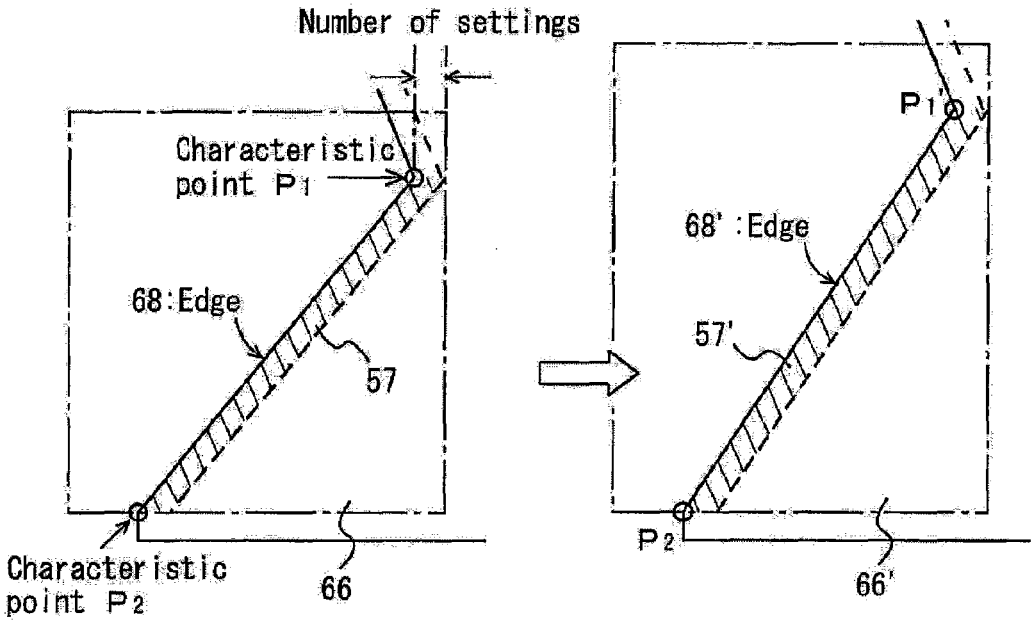
FIG. 8 is a view schematically showing a change of the setting area of the embodiments, the change being caused in response to a change of the external shape.

FIG. 8 shows an example of a change of a setting area, the change being caused by a change in the external shape. In the case in which the setting area 57 is designated, characteristic points P1 and P2 at respective upper and lower ends of, for example, a waist are designated, and the area that extends inward by the number of settings from a knitted fabric edge 68 for connecting the characteristic points P1 and P2 is taken as the setting area 57. Then, a setting layer 66 containing the setting area 57 is defined, and data on the shape of the setting area and on the setting pattern expanded within the setting area are taken as the data on the layer 66. Here, the external shape of the knitted fabric is changed, whereby the characteristic point P1 is moved to P1'. The area modifying section 28 detects that the characteristic point P1 is moved to P1' and that the edge is changed to an edge 68', and modifies the data so that a setting area 57' and a layer 66' are obtained. The characteristic point corresponds to the characteristics of the external shape of the knitted fabric, thus a change of the characteristic point can be extracted when the external shape is changed.

Figure 9:
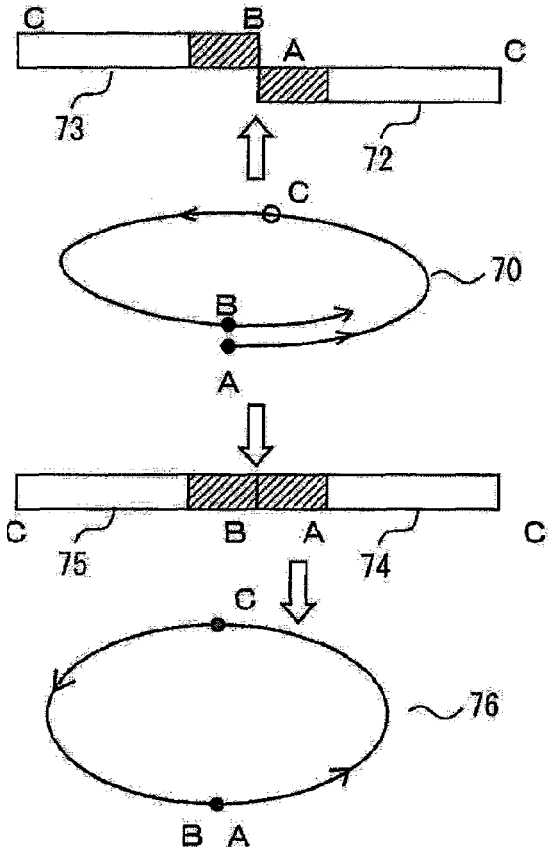
FIG. 9 is a view showing a mechanism in which a level difference is generated between the front and rear setting patterns during tubular formation.
Figure 10:
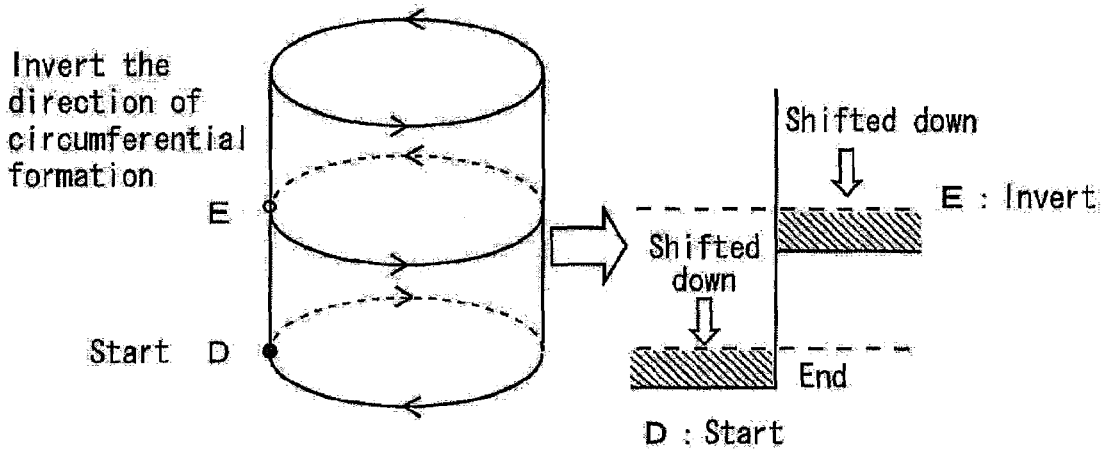
FIG. 10 is a view schematically showing the orientation of the level difference when a circumferential direction is changed in mid-course.

FIG. 9 shows a location where a level difference is generated. For example, circumferential formation 70 is performed from a start point A toward an end point B. The start point A and the end point B are located at the boundary between the front knitted fabric and the rear knitted fabric, and the boundary on the opposite side is a half-cycle point C. The formation data on this half-cycle point C is as shown in the second drawing from the bottom of FIG. 9, wherein reference numeral 74 represents rear knitted fabric data, and reference numeral 75 represents front knitted fabric data. Here, formation is performed starting from the start point A to the half-cycle point C on the rear knitted fabric side, and then formation is performed on the front knitted fabric side. In a stitch array 76 on the formation data, one circle of stitches is tubularly connected. However, in an actual knitted fabric, the end point B is connected to a stitch located on one course above the start point A, so stitch arrays 72 and 73 in a natural state are as shown in the top of FIG. 9, whereby a level difference equivalent to one course is generated between the setting pattern in the A section and the setting pattern in the B section.

To describe the start point and the end point, the start point A and the end point B are connected vertically to each other in the wale direction as long as the direction of circumferential formation is not inverted during the formation. Therefore, the start point A is a start point obtained when the circumferential formation is started, and the end point B is an end point obtained at the first one cycle of circumferential formation. If the direction of circumferential formation is inverted during the formation, the relationship between the start point and the end point is reversed. For example, suppose that the circumferential formation is started at D shown in FIG. 10, and the direction of circumferential formation is inverted at E. Consequently, the setting pattern to be shifted down in the section between D and E and the setting pattern to be shifted down in the section above E are reversed. In other words, if the direction of circumferential formation is inverted during the formation, the start point and the end point may be defined along the direction of circumferential formation that is obtained after the inversion.

Figure 11:
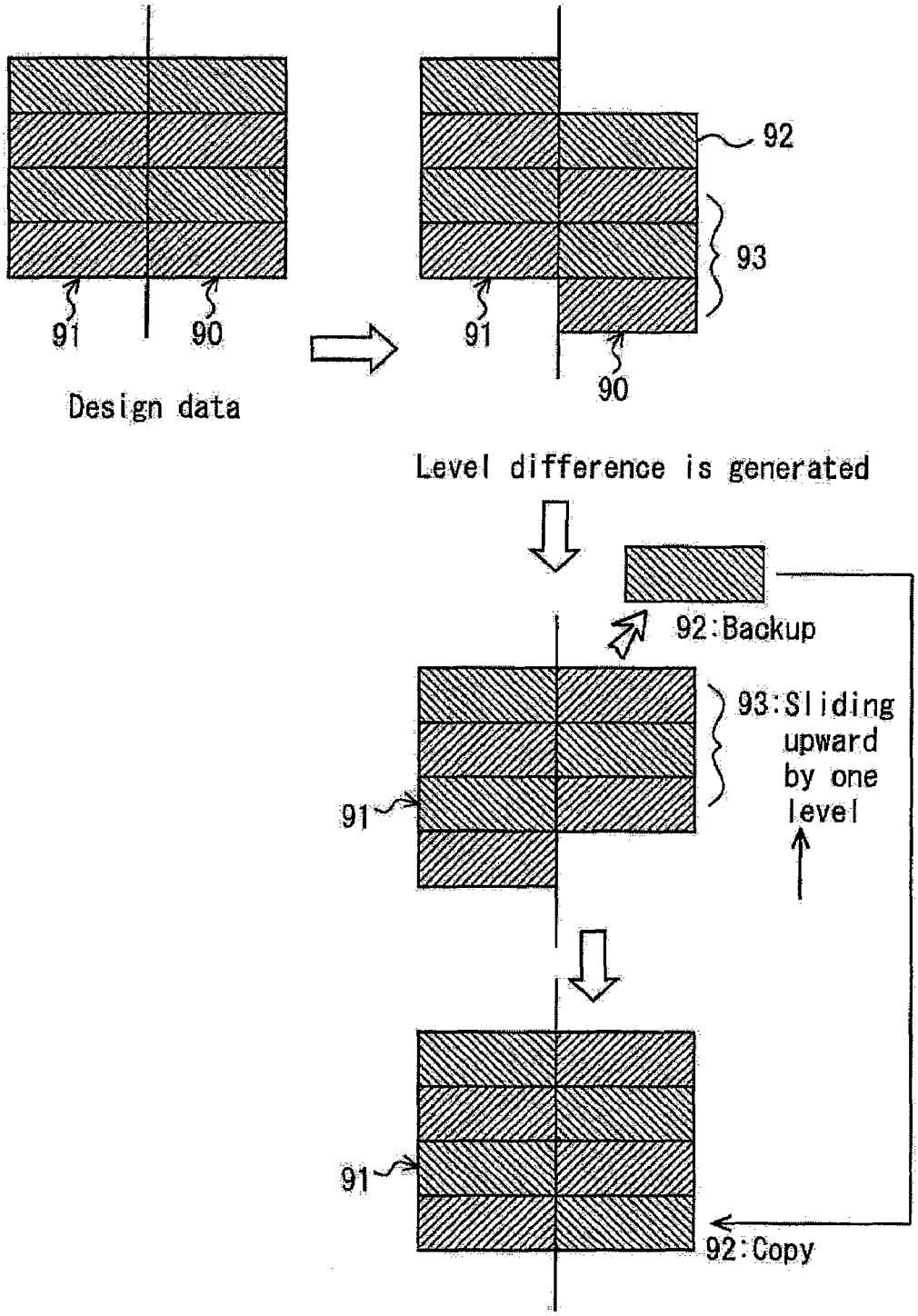
FIG. 11 is a view schematically showing how front/rear correction is performed on the setting patterns according to the embodiments.

FIG. 11 shows the correction performed at the location where the level difference is generated. Suppose that setting patterns 90 and 91 exist in a continuous fashion on both sides of the circumferential formation start point. Further, each hatching indicates the type of stitches or one course of patterns. In the knitted fabric that is obtained after the formation and thereby is in a natural state, the setting pattern 90 on the start point side is shifted down by one course with respect to the setting pattern 91 on the end point side. When correction is performed on such shifting, one course of data at the uppermost level is backed up, the rest of data 93 is slid upward by one course, and the backed up data 92 at the uppermost level is copied to the lowermost course.

The whole setting pattern 90 may be slid upward by one course, but in this case an area having no designated stitch type remains in the lowermost course of the setting pattern 90. Therefore, the type of a stitch needs to be input into this section. In order to avoid this input work, the data 92 of the uppermost level is copied to the lowermost level. It should be noted that the setting pattern 90 is obtained by repeatedly and periodically forming a unit pattern, and deterioration of the beauty thereof is prevented by connecting the pattern of the lowermost course to the pattern of the uppermost course. Also, in the processing shown in FIG. 11, the processing is pointless if the unit pattern is constituted by one course, thus the processing is not performed.

In the embodiments, a setting pattern can be designed without considering a change of the external shape of each of the knitted fabric, and the setting pattern does not become discontinuous at the boundary between the front and rear knitted fabrics. In the embodiments, if a level difference is generated between the front and rear setting patterns at the stage of creating the setting pattern, level difference correction is performed. Then the user displays the design on the monitor and evaluates the design obtained after level difference correction. Therefore, the user can design the setting pattern without considering the level difference. However, the level difference may be corrected when the design is determined.

The invention claimed is:

1. A computer implemented designing device for creating design data of a knit product in order to form a cylindrically-shaped fabric constituted by front and rear knitted fabrics by means of a flat-knitting machine by circumferentially moving a yarn carrier, and to form a setting pattern on an end section of each of the knitted fabrics, the designing device comprising:

designating means for accepting that a setting area is designated and storing the designated setting area on a memory in association with an external shape of each of the knitted fabrics;

modifying means for modifying the setting area in response to an alteration of an external design of each of the knitted fabrics;

expanding means for storing data on the setting pattern on the memory and expanding the pattern through the entire setting area;

detecting means for detecting that the setting area exists in both circumferential direction start section and end section located respectively on both sides of a carrier circumferential movement start section and that the setting area also exists so as to continue along a course direction between the start section and the end section; and correcting means for moving on the data stored on the memory, at the time of the detection, the setting pattern located on the start section side relatively upward to the end section side by one course.

2. The computer implemented designing device according to claim 1, wherein the designating means accepts that the both end sections of the setting area are designated, stores the designated both end sections on the memory in association with the external shape of each of the knitted fabrics, and stores an area of a predetermined number of wales between the designated ends as the setting area on the memory, the predetermined number of wales being counted inward from an edge of each of the knitted fabrics, the modifying means moves both of the end sections in response to the alteration of the external design of each of the knitted fabrics, and the expanding means stores data on a pattern on the memory in units of the setting pattern, and copies the data so that the pattern spreads through the entire setting area.

3. The computer implemented designing device according to claim 1, wherein, on the start section side, the correcting means moves on the data the uppermost course of the setting pattern to the lowermost course of the setting pattern, and shifts on the data a setting pattern of another course upward by one course.

4. A computer implemented designing method of creating design data of a knit product in order to form a cylindrically-shaped fabric constituted by front and rear knitted fabrics by means of a flat-knitting machine by circumferentially moving a yarn carrier, and to form a setting pattern on an end section of each of the knitted fabrics, the designing method comprising:

accepting that a setting area is designated and storing the designated setting area on a memory in association with an external shape of each of the knitted fabrics;

modifying the setting area in response to an alteration of an external design of each of the knitted fabrics;

storing data on the setting pattern on the memory and expanding the pattern through the entire setting area; and when detection is made that the setting area exists in both circumferential direction start section and end section located respectively on both sides of a carrier circumferential movement start section and that the setting area also exists so as to continue along a course direction between the start section and the end section, moving on the data stored on the memory the setting pattern located on the start section side relatively upward to the end section side by one course.

5. The computer implemented designing method according to claim 4, wherein in the designating, designation of the both end sections of the setting area is accepted, the designated both end sections are stored on the memory in association with the external shape of each of the knitted fabrics, and an area of a predetermined number of wales between the designated ends is stored as the setting area on the memory, the predetermined number of wales being counted inward from an edge of each of the knitted fabrics, in the modifying, the both end sections are moved in response to the alteration of the external design of each of the knitted fabrics, and in the expanding, data on a pattern in units of the setting pattern is stored on the memory and then copied so that the pattern spreads through the entire setting area.

6. The computer implemented designing method according to claim 4, wherein in the upward movement by one course, on the start section side, the uppermost course of the setting pattern is moved on the data to the lowermost course of the setting pattern, and a setting pattern of another course is shifted on the data upward by one course.

7. A designing program, on a computer-readable medium, for creating design data of a knit product in order to form a cylindrically-shaped fabric constituted by front and rear knitted fabrics by means of a flat-knitting machine by circumferentially moving a yarn carrier, and to form a setting pattern on an end section of each of the knitted fabrics, the designing program comprising:

a designating command for accepting that a setting area is designated and storing the designated setting area in association with an external shape of each of the knitted fabrics;

a modifying command for modifying the setting area in response to an alteration of an external design of each of the knitted fabrics;

an expanding command for storing data on the setting pattern and expanding the pattern through the entire setting area;

a detecting command for detecting that the setting area exists in both circumferential direction start section and end section located respectively on both sides of a carrier circumferential movement start section and that the setting area also exists so as to continue along a course direction between the start section and the end section; and a correcting command for moving on the data, at the time of the detection, the setting pattern located on the start section side relatively upward to the end section side by one course.

8. The designing program according to claim 7, wherein the designating command is used to accept that the both end sections of the setting area are designated, store the designated both end sections in association with the external shape of each of the knitted fabrics, and store an area of a predetermined number of wales between the designated ends as the setting area, the predetermined number of wales being counted inward from an edge of each of the knitted fabrics, the modifying command is used to move the both end sections in response to the alteration of the external design of each of the knitted fabrics, and the expanding command is used to store data on a pattern in units of the setting pattern, and to copy the data so that the pattern spreads through the entire setting area.

9. The designing program according to claim 7, wherein, on the start section side, the correcting command is used to move on the data the uppermost course of the setting pattern to the lowermost course of the setting pattern, and to shift a setting pattern, on the data, of another course upward by one course.

* * * * *